United States Patent [19]

Torres

[11] Patent Number: 4,655,725

[45] Date of Patent: Apr. 7, 1987

[54] ANIMATED FIGURE TOY

[75] Inventor: Ronald L. Torres, Pico Rivera, Calif.

[73] Assignee: Mattel, Inc., Hawthorne, Calif.

[21] Appl. No.: 786,558

[22] Filed: Oct. 11, 1985

[51] Int. Cl.[4] ..... A63H 3/20

[52] U.S. Cl. ..... 446/246; 446/336; 446/359

[58] Field of Search ..... 446/359, 352, 353, 354, 446/358, 236, 237, 330, 335, 336, 246

[56] References Cited

U.S. PATENT DOCUMENTS 2,639,547 5/1953 Adler .
3,147,566 9/1964 Ong ..... 446/359
3,684,291 8/1972 Johmann .
3,705,726 12/1972 Johmann .
3,775,900 12/1973 Thorn et al. .
3,955,311 5/1976 Lyons .
4,047,325 9/1977 Yamazaki ..... 446/237

*Primary Examiner*—Mickey Yu
*Attorney, Agent, or Firm*—Ronald Goldman; Melvin Klein; Daniel Sullivan

[57] ABSTRACT

A figure toy having an upper torso with an arm member pivotally coupled to the shoulder portion thereof, the arm member being hollow and including therein a rotatable assembly having a bevel gear at the shoulder area and a connector adjacent the wrist portion for connection to one of a plurality of simulated weapons which may be rotated. A rotatable wheel within the torso is gear connected to the rotatable assembly within the arm, rotation of the simulated weapon being effected by manually driving the wheel.

5 Claims, 6 Drawing Figures

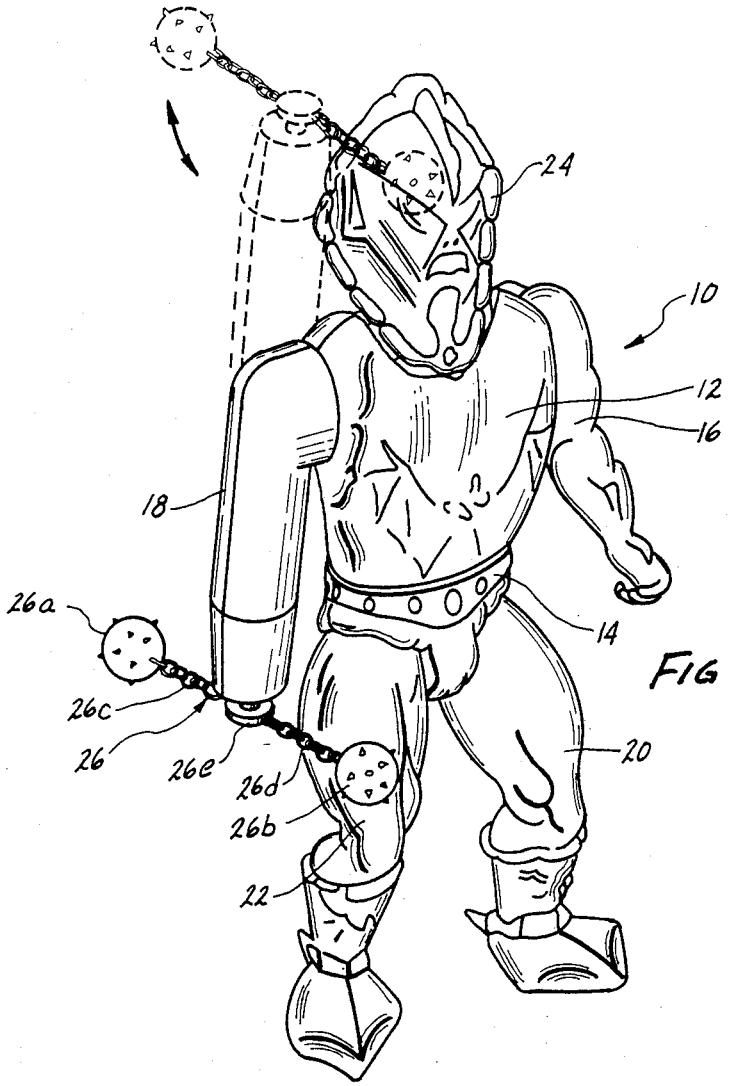
FIG 1
FIG 5
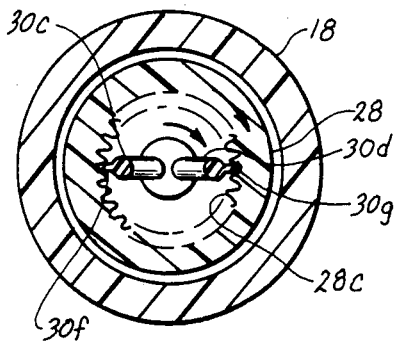
FIG 6
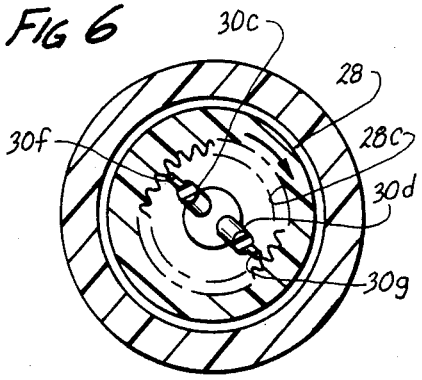

ANIMATED FIGURE TOY

BACKGROUND OF THE INVENTION

The background of the invention will be discussed in two parts:

Field of the Invention

This invention relates to animated figure toys, and more particularly to an animated figure toy with a mechanism in the arm for rotating simulated weapons.

Description of the Prior Art

Toy figures having posable or movable articulated limbs are very popular with children, with some such figures being referred to as action figures. Action figures usually have some distinguishing characteristics, such as being configured as the super hero type of figure, and usually such figures are provided with action accessories, such as vehicles and the like to enable the child to configure an action setting.

Some such action figures are provided with mechanisms within the torso, or one of the appendages, usually spring-actuated, to enable some form of action such as throwing a punch, or raising an arm or the like, in response to the operation of some control means, such as a depressible lever or the like. Some such figures are provided with other accessory items for simulating human activity.

One such device is shown and described in U.S. Pat. No. 2,639,547, issued May 26, 1953, to Adler for a "Mechanical Figure Simulating Pouring and Drinking Liquid", this figure toy including a spring actuated motor manipulating articulated appendages holding a bottle and glass for simulating pouring of liquid from the bottle into the glass, whereupon the arm is moved to carry the glass to the mouth of the figure toy to simulate drinking.

Another animated figure toy is shown and described in U.S. Pat. No. 3,684,291, entitled "Dice-Throwing Doll", issued Aug. 15, 1972, to Johmann, such doll being operated by an electrical motor and including an articulated arm member having a cup attached to the hand thereof, for receiving dice therein. A mechanism is provided for shaking or vibrating the hand and for tilting the same to discard the dice onto a surface.

Another animated figure toy is shown and described in U.S. Pat. No. 3,705,726, entitled "Pointer Spinning Mechanical Doll", issued Dec. 12, 1972 to Johmann, the doll having the feet thereof attached to a structure including a rotatable member in reach of the arm of the doll, actuation of the arm by a mechanism controlled via an electric motor spinning the rotatable pointer member.

U.S. Pat. No. 3,955,311, issued May 11, 1976 to Lyons et al is entitled "Mechanism for Moving an Upper Appendage of a Toy Figure", such patent disclosing a figure toy having an articulated arm member actuated upon depression of a button in the side of the torso, which, through mechanical linkages, pivots the arm to simulate life-like movement.

Another animation mechanism for a toy figure is shown and described in U.S. Pat. No. 3,775,900, entitled "Toy Doll", which patent issued to Thorn et al on Dec. 4, 1973, the doll being motorized and having an articulated arm member driven thereby, the forearm portion thereof oscillating in a selectable predetermined plane to simulate the strumming of a guitar or the like.

It is an object of the present invention to provide a new and improved animated figure toy.

It is another object of the present invention to provide a new and improved manually operated animated figure toy.

It is a further object of the present invention to provide a new and improved animated figure toy having an arm with a rotatable mechanism therein configured for attachment thereto of one of a plurality of accessory items.

SUMMARY OF THE INVENTION

The foregoing and other objects are accomplished by providing a figure toy having an upper torso with an arm member pivotally coupled to the shoulder portion thereof, the arm member being hollow and including therein a rotatable assembly having a bevel gear at the shoulder area and a connector adjacent the wrist portion for connection to one of a plurality of simulated weapons which may be rotated. A rotatable thumbwheel within the torso is gear connected to the rotatable assembly within the arm, rotation of the simulated weapon being effected by manually driving the wheel.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is a perspective view of the animated figure toy according to the present invention;

FIG. 5 is a cross-sectional view of a clutch mechanism within the arm portion of the torso and arm assembly of FIG. 3 as viewed generally along line 5—5 thereof depicting clutch action between the parts; and FIG. 6 is a cross-sectional view similar to FIG. 5 depicting slippage between the parts of the clutch mechanism.

DESCRIPTION OF THE PREFERRED EMBODIMENT

Figure 2:
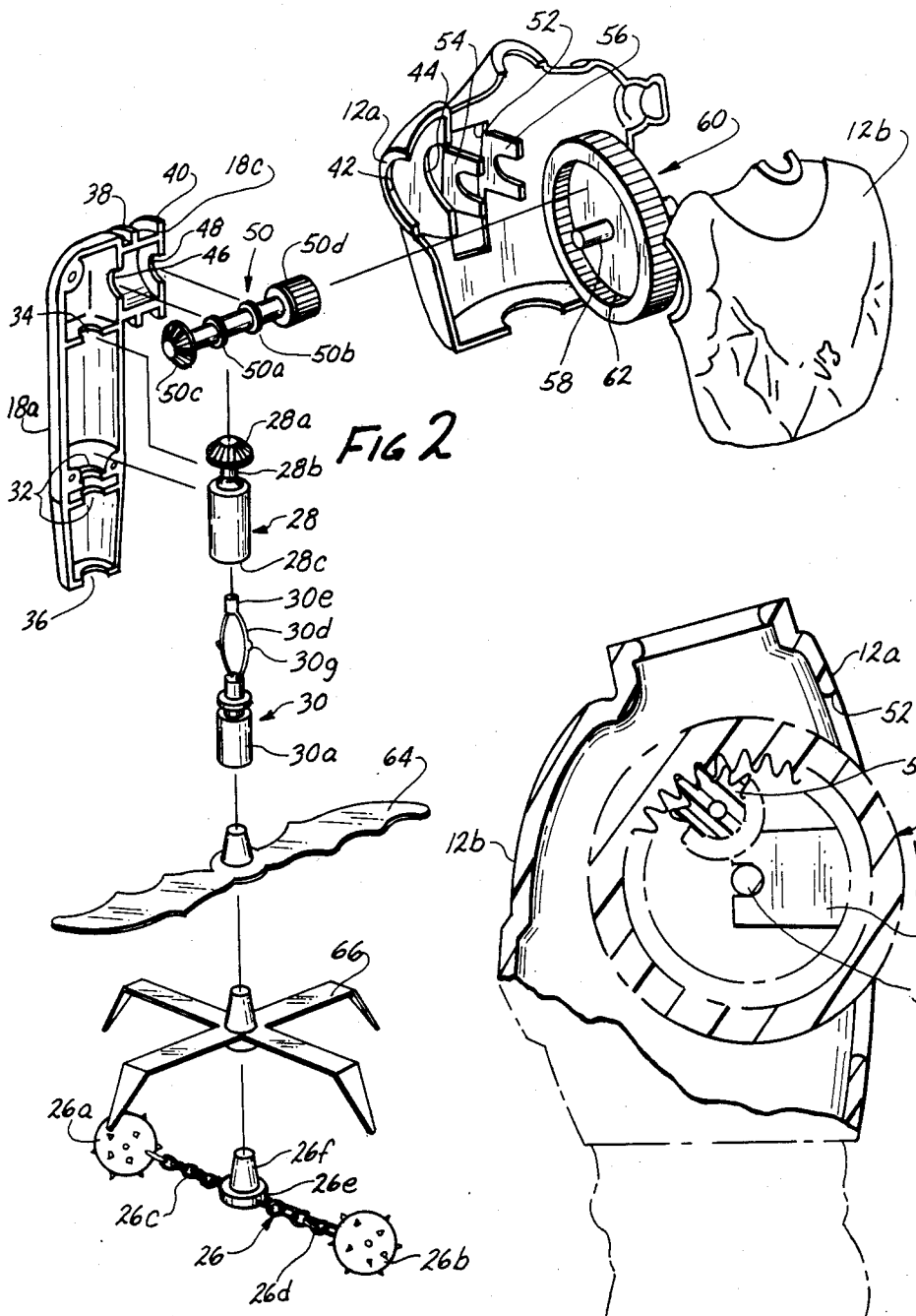
FIG. 2 is an exploded perspective view of the operative components of the animated figure toy of FIG. 1.

Referring now to the drawings, and particularly to FIG. 1, there is shown a toy figure, generally designated 10, having an upper torso 12, a lower torso 14, a pair of arms 16 and 18, a pair of legs 20 and 22, and a head 24. Each of the arms 16 and 18 is pivotally supported in or by the upper torso 12, at the shoulder portion (see, for example, FIG. 3). Similarly, the legs 20 and 22 are pivotally attached in or to the lower torso 14.

The head 24 is configured in the form of a fanciful creature, such as an archenemy of a superhero, or the like. Similarly the arm 18 is configured as an artificial arm to exemplify the villain aspect of the toy 10. Coupled to the lower end of the arm 18 is a simulated weapon, generally designated 26, in the form of a pair of spiked balls 26a and 26b with simulated chain members 26c and 26d interconnecting the balls and a central coupling portion 26e. As will be hereafter described, a plurality of such simulated weapons 26 my be supplied with a figure toy 10, each having generally identical coupling portions 26e. Also as shown in dotted lines, the arm 18 and the weapon 26 may be pivoted to an elevated position for unobstructed rotation of the weapon 26.

Figure 4:
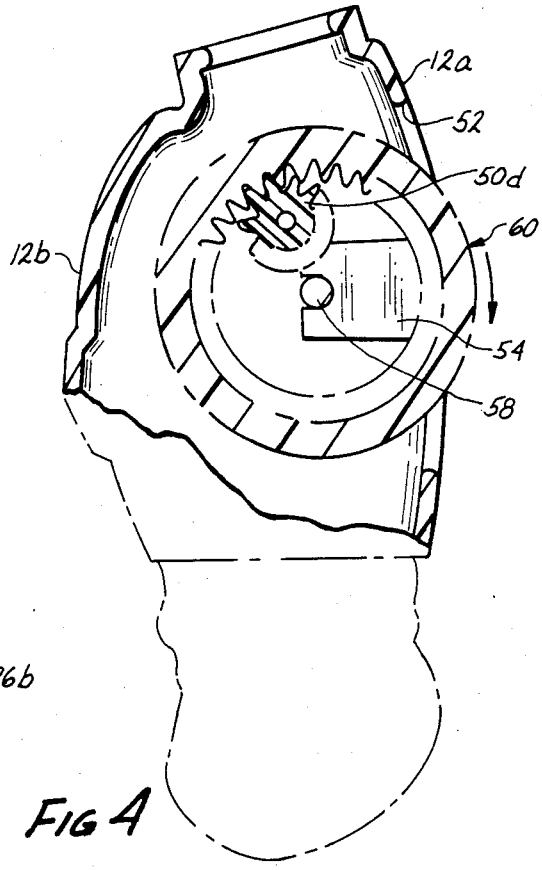
FIG. 4 is a cross-sectional view of the upper torso and arm of FIG. 3 as viewed generally along line 4—4 thereof.
Figure 3:
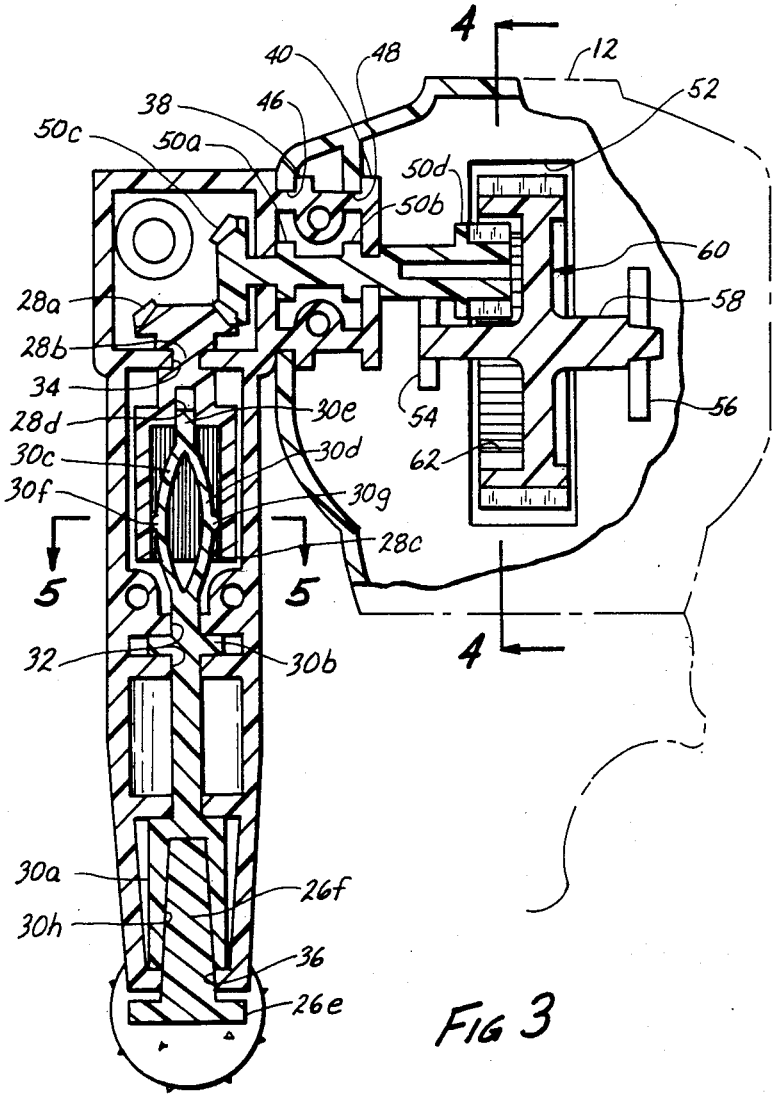
FIG. 3 is a partial cross-sectional view of the upper torso and one arm of the animated figure toy of FIG. 1, as viewed generally along a generally central plane extending through the shoulders thereof to illustrate the interior mechanism.

Referring now to FIGS. 2 through 4, attention is directed to the upper torso 12 and the arm 18 which contain the operative components of the mechanism for rotation of the weapon 26. For this purpose, the arm 18 is generallly hollow and has the interior thereof configured to provide bearing supports for a rotatable assembly including an upper member, generally designated 28 and a lower member, generally designated 30.

The upper member 28 has a bevel gear portion 28a with a necked down bearing shaft portion 28b and a cup-shaped opening 28c with a serrated circumferential surface, which as will be described is a part of a slip clutch mechanism. The lower member 30 includes a coupling portion 30a with a necked down bearing flange 30b thereabove. Extending in an axial direction therefrom is a pair of arcuately configured deformable and resilient diametrically opposed clutch fingers 30c and 30d interconnected at the upper end and terminating as a bearing projection 30e.

In FIGS. 2 and 3, it can be seen that the arm 18 and the upper torso 12 are formed in two parts to define hollow openings, the two parts being designated with letter suffixes. Although only the rear portion 18a of the arm 18 is depicted, it is to be understood that the other half will have similar mating portions to accomplish the intended function. The arm 18a is configured with a slotted and arcuately relieved pair of bearing webs 32 configured to receive the bearing flange 30b of the lower rotatable member in axially captive relation. Similarly the upper portion of arm 18a is provided with a bearing web 34 arcuately cutaway for receiving therein the bearing portion 28b of the upper rotatable member 28.

As more fully shown in FIG. 3, with the upper and lower members 28 and 30 fitted into the arm 18, the fingers 30c and 30d fit within the cup-shaped opening 28c with the bearing projection 30e rotatably engaging a centrally disposed aperture 28d formed within the base of the opening 28c, thus interconnecting the upper and lower members 28 and 30. The clutch means are provided, in part, by outwardly extending tabs 30f and 30g formed at the approximate midpoint of the arc of the fingers 30c and 30d, respectively. These outwardly extending tabs 30f and 30g are dimensioned for engagement with the inner serrated circumference of the cup-shaped clutch opening 28c thereby normally coupling upper and lower members 28 and 30 for concurrent rotation (See also FIGS. 5 and 6).

The coupling portion 30a of the lower member 30 has an inner opening 30h formed as a frusto-conical configuration for receiving therein a matingly configured connector portion 26f of the coupling portion 26e of the weapon 26. The connection is thus wedge-shaped in which event the weapon 26 may be readily coupled to the lower rotatable member 30 by applying pressure. As illustrated in FIGS. 2 and 3, the lower end of the arm 18 is provided with an access opening 36 to permit insertion of the connector portion 26f.

The arm 18 is provide with an integrally formed shoulder coupling portion 18c which extends generally perpendicular to the longitudinal center line of the arm 18, the coupler portion 18c having outer peripheral flanges 38 and 40, which coact with a matingly configured shoulder opening 42 and a matingly configured web portion 44 formed within the upper torso 12 for pivotally coupling the arm 18 to the torso 12. The interior of the coupling portion 18c has integrally formed therein a pair of spaced aligned bearing cutouts 46 and 48, which form the journals for rotatably receiving the flange portions 50a and 50b of a drive shaft 50 therebetween (See FIG. 3). The drive shaft 50 has a bevel gear end 50c configured for meshing engagement with the bevel gear 28a of the upper rotatable member 28. The other end of drive shaft 50 has a pinion gear 50d for driving the gear train.

For enabling manual operation, the rear half 12a of the torso 12 is provided with a longitudinally extending generally rectangular slot 52, with the interior of the torso 12 having integrally formed generally parallel cutaway bearing webs 54 and 56 on either side of the slot 52 for rotatably supporting the axle 58 of a manually driven thumbwheel, generally designated 60, the thumbwheel 60 being so dimensioned that a portion thereof protrudes from the rear of the rear torso half 12a (See FIG. 4) for manual rotation by the child.

The thumbwheel 60 is configured as a relatively large diameter wheel with a thick peripheral rim and a relatively thin central portion, the undersurface 62 of the rim having gear teeth formed therein for meshing engagement with the pinion gear 50d of the drive shaft 50. The outer surafe of the rim portion is abraded or serrated to facilitate gripping for rotation. With this configuration, the bulk of the mass of the thumbwheel 60 is adjacent the outer rim, and with the gear surface 62 on the interior of the rim, a substantial gear ratio is effected, with a flywheel effect being obtained, thereby simplifying rotation by a child.

In use, the weapon 26 has the coupling portion 26f fixed in position within the coupling opening 30h of the lower rotatable member 30. The thumbwheel 60 is rotated thereby driving drive shaft 50, which, in turn, rotates the upper rotatable member 28 via bevel gears 50c and 28a. The clutch means, in the absence of an obstruction transmit this rotation to the lower member 30 by means of the tabs 30f and 30g of fingers 30c and 30d engaging the inner serrations of the cup-shaped opening 28c, with this rotation being transmitted to the weapon 26.

Referring also to FIGS. 5 and 6, the slip clutch connection is depicted, in FIG. 5, in the normal condition, that is, with the lower member 30, as indicated by the arrows thereon, concurrently driven by the upper member 28. In this condition, the tabs 30f and 30g of fingers 30c and 30d engage the inner serrations of the cup-shaped opening 28c. In FIG. 6, the upper member 28 is rotating, as shown by the arrow thereon, with the lower member 30 stationary, this condition disabling rotation of the weapon 26 upon impact with an obstruction.

As shown in FIG. 2, other weapons 64 and 66 may also be provided with each being in the form of a symmetrical sword arrangement or shears. Other such simulated weapons or other accessory devices may be readily devised for attachment to the rotatable mechanism within the arm 18, as desired, those shown being exemplary.

While there has been shown and described a preferred embodiment, it is to be understood that various other adaptations and modifications may be made within the spirit and scope of the invention.

I claim:

1. In a figure toy, the combination comprising:

an upper torso;

a generally hollow arm member pivotally coupled to said upper torso; means rotatably mounted within said arm member including (a) connector means adjacent the free end of said arm member, (b) first and second members interconnected through slip clutch means, (c) a drive shaft having a pinion gear adjacent one end coacting with a gear surface on a thumbwheel and a bevel gear adjacent the other end coacting with a bevel gear on one of said first and second members;

said thumbwheel rotatably mounted in said upper torso for causing rotation of said rotatable means, said thumbwheel extending partially out from said upper torso through a slot therein and being manually operable, said rotatably mounted means being driven by said thumbwheel by a gear surface on said thumbwheel coacting with said pinion gear; and an accessory device adapted for coupling to said connector means for rotation thereof in response to actuation of said thumbwheel.

2. The toy according to claim 1 wherein said accessory device is a simulated weapon.

3. The toy according to claim 2 wherein said thumbwheel includes a peripheral rim portion with gear teeth formed on the inner surface thereof for engaging said gear means.

4. The toy according to claim 1 wherein said slip clutch means includes a cup-shaped opening on one of said first and second members, said opening having a serrated inner circumferential surface, and resilient finger means on the other of said first and second members within said opening, said finger means being configured for normal engagement with said serrated inner surface for concurrent rotation therewith, and for slipping relative thereto when said accessory device is precluded from rotation.

5. In a figure toy, the combination comprising:

an upper torso;

a generally hollow arm member having a shoulder portion pivotally coupled to said upper torso;

first and second members interconnected by slip clutch means and being rotatably mounted within said arm member, one of said first and second members having a gear portion adjacent said shoulder portion and the other of said first and second members having connector means adjacent the end thereof;

a manually operable thumbwheel in said upper torso, said thumbwheel including a peripheral rim portion with gear teeth formed on the inner surface thereof;

gear means driven by said gear teeth and coating with said gear portion for causing rotation of said first and second members; and an accessory device adapted for coupling to said connector means for rotation thereof in response to actuation of said thumbwheel, said slip clutch means being configured for enabling concurrent rotation of said first and second members when rotated by said thumbwheel, and for enabling slipping between said first and second members when said accessory device is precluded from rotation.

* * * * *